United States Patent [19]

Auer

[11] 4,286,196

[45] Aug. 25, 1981

[54] AUTOMATIC DIMMER CUTOUT FOR ARC LAMP OF FIBER OPTIC LIGHT SOURCE

[76] Inventor: William F. Auer, 1654 E. Walnut, Des Plaines, Ill. 60016

[21] Appl. No.: 121,477

[22] Filed: Feb. 14, 1980

[51] Int. Cl.[3] ..... G05F 1/00

[52] U.S. Cl. ..... 315/307; 315/291; 315/311; 315/DIG. 4; 315/DIG. 7

[58] Field of Search ..... 315/307, 310, 311, DIG. 4, 315/DIG. 7, 291, DIG. 5

[56] References Cited

U.S. PATENT DOCUMENTS 3,919,592 11/1975 Gray ..... 315/DIG. 4

*Primary Examiner*—Harold A. Dixon

*Attorney, Agent, or Firm*—James J. Conlon

[57] ABSTRACT

A control circuit and method is provided to automatically cut out a dimmer circuit from a high intensity light source until the light source has first been triggered and turned on at a high intensity level with the required high voltage. After an initial high illumination occurs a dimmer control circuit is electronically cut into the light circuit and a dimmer control knob, connected with a potentiometer, may then be used to raise or lower the illumination of the high intensity lamp. Thus, the high intensity lamp will be turned on regardless of the position of the dimmer control. Without the control circuit, the high intensity lamp would not trigger if the control knob was at a low intensity setting.

7 Claims, 4 Drawing Figures

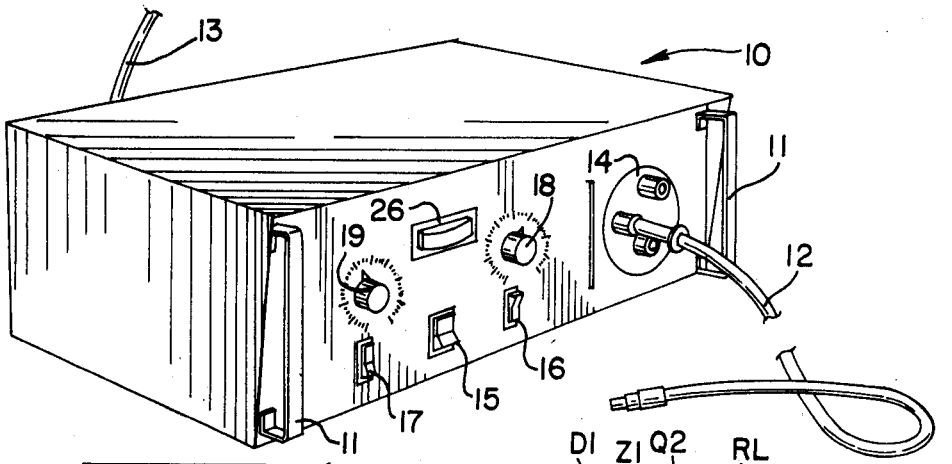
FIG. 1
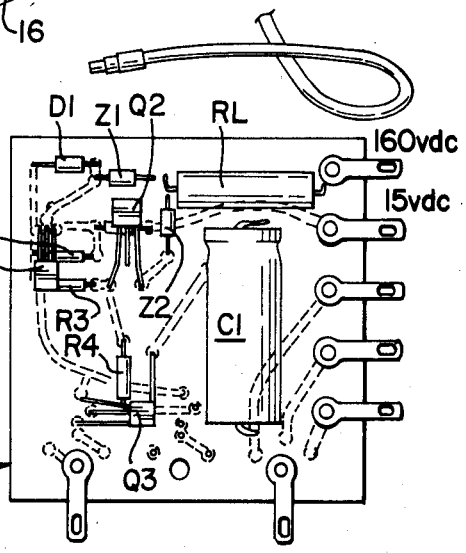
FIG. 3
FIG. 2
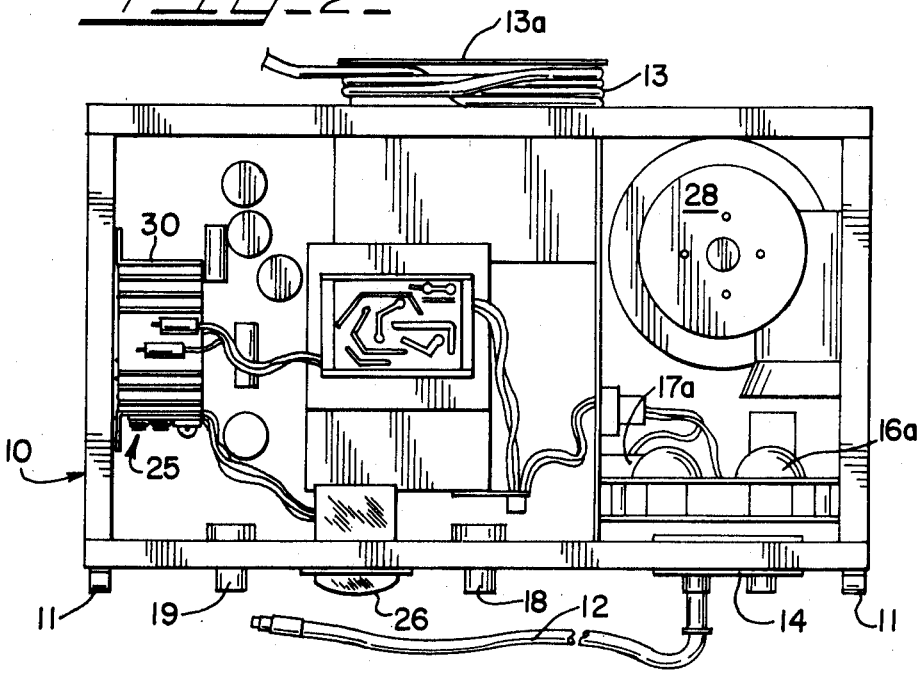

AUTOMATIC DIMMER CUTOUT FOR ARC LAMP OF FIBER OPTIC LIGHT SOURCE

BACKGROUND OF THE INVENTION (1) Field of the Invention

This disclosure pertains to an electronic control circuit for high intensity fiber optic light sources used in surgery, dentistry, and other applications such as inspection of aircraft and the like where a fiber optic cable carries light to the point of use to provide a high intensity light.

(2) Description of the Prior Art

Modern enclosed arc lamps as made by G.E. and others have natural characteristics that require a certain sequence of operations to place them into condition to ignite and then to continue illumination after ignition. Also, the lamp intensity can be varied from its maximum intensity to a usable low intensity once the lamp has gained a certain operating condition.

Power supplies are now manufactured that provide the sequence of operations necessary for proper illumination. Also, these power supplies now furnish the necessary electronic circuitry to vary the intensity of the lamp after initial ignition. However, the point at which an operator may adjust the lamp intensity, without extinguishing the lamp, is determined by the operator, and is not automatic. Further, if the intensity setting is low at the time the unit is turned on, the arc lamp will not receive the required voltage to trigger itself into an on condition. This invention provides a circuit which allows the lamp to trigger regardless of the setting of the brightness control. This disclosure shows a circuit which utilizes the lamp's own electronic condition to automatically energize the dimming circuit to cut in and engage when all conditions are correct for proper illumination and for proper dimming control.

Prior high intensity lamps (enclosed arc lamps) are triggered initially through a capacitor which is discharged causing a high voltage surge (approx. 7500 volts) across the lamp electrodes. This initial voltage surge causes minute ionization reducing the gas resistance sufficiently to permit a second, highly capacitive discharge (approx. 160 volts DC), to flow across the lamp electrodes, further ionizing the gases and initiating illumination.

After these initial voltage surges, the power supply controls the amperage permitted to flow in the lamp at approximately 7.8 amperes d.c. However, at the 7.8 amp. level, the voltage across the electrodes will initially drop to approximately 12 volts d.c. Next, the power supply will permit the voltage across the lamp electrodes to rise to its normal full illumination of 35 to 45 volts d.c., while the amperage is maintained at 7.8 amperes. Until the lamp has received and conditioned itself to approximately 24 volts d.c., the dimming control which reduces the amperage across the lamp electrodes, and, adjusts the intensity of the lamp, should not be used. If the dimming control was permanently wired into the lamp ignition circuit, and the control potentiometer set to a low position, the power circuit could not control the lamp and place it into an ignition condition. Under such a low illumination setting, it would then be necessary to increase the control potentiometer setting (increase the brightness setting) before a successful ignition could occur.

The above facts regarding inability of the lamp to trigger if the brightness control is at a low setting may seem insignificant at first reading until a few other factors are considered. Personnel using this equipment would only know of this lamp characteristic and inability to trigger at a low intensity setting by studying the operating manual, or, using the instrument on many occasions to familiarize themselves with it. Unfortunately, a manufacturer of instruments sold to the general public must realize ideal conditions never exist and regardless of previous explanation, customers demand the unit works when they flip the switch.

Another point and a more irritating one to our customers is the fact that the enclosed arc lamp has a delay in trying to restart itself once it has been ignited, even if ignited only for a very short period of time. This is a natural characteristic of the gases used in the lamp construction. The lamp can start easily in a cold condition; however, once the gases are warmed up, the lamp will not restart until the gases have cooled again to a certain level. In a fully illuminated lamp, delay can be a time interval of a full minute while in false starts it is, of course, a lesser time, but nevertheless irritating. Because of these facts, it is necessary that an automatic means be provided for the lamp to properly ignite, remain ignited until ready for dimming control, and then the actual dimming control be electronically connected when ready.

Problems involved in the prior art are overcome by the instant invention which provides an automatic triggering of the light source regardless of the intensity setting of a control knob on the control panel and its associated control potentiometer.

SUMMARY

This disclosure pertains to a control circuit for use with light sources having high intensity arc projection lamps. The arc lamps are adapted to feed an adjustable high intensity light into a fiber optic cable to produce a light for use by physicians, dentists, surgeons, and other personnel requiring such so-called fiber optic light sources for inspection of aircraft, industrial equipment and for maintenance, repairs and the like. More specifically, this disclosure provides an electronic control circuit to be added to a conventional arc lamp control circuit that has a dimmer control for adjusting the intensity of the lamp. The control circuit of this disclosure allows a high voltage to be initially applied across the electrodes of an arc lamp to initially trigger and illuminate the lamp at the required high voltage. After the initial triggering occurs, the control circuit of this disclosure will be automatically cut in, and, the lamp will be set at the intensity corresponding with a setting of an intensity control knob on the panel of the unit.

Electronically, the circuit consists of three transistors that are controlled to either a conducting condition or off-condition as the lamp goes through its initial cycle necessary for proper triggering and illumination. The entire purpose of this circuit is to hold the third transistor in a non-conducting condition until the lamp has triggered and is ready for the dimming control circuit to be applied.

The control circuit is wired across the lamp and because of this it must start its control with the 160 volt d.c. voltage. The 7500 volt pulse is present also, but the designers of the present power supplies have provided a means whereby this voltage is applied to the lamp but it is not sensed in the 160 volts d.c. circuit.

With the lamp at rest, not ignited, the 160 volts d.c. is placed across and applied to the central circuit and across the lamp.

The 160 volts flows across a limiting resistor, a 51 volt zener limiting diode and a simple rectifier diode. All silicon diodes in conducting condition have a voltage drop of approximately 0.6 volts. Thus, we use this voltage across the simple diode to bias transistor No. 1 in a conducting condition. While transistor No. 1 is conducting, it effectively shorts out a first resistor associated with transistor No. 2. With the first resistor shorted out, there is insufficient bias to transistor No. 2 to place it into a conducting condition. With transistor No. 2 in a non-conducting condition, the 160 volts d.c. cannot flow through a second path through transistor No. 2. That is, the 160 volts d.c. cannot flow through a zener diode connected to the collector of transistor No. 2. Therefore, no current flows in a third resistor connected with the emitter of transistor No. 2, no voltage is developed across the base of transistor No. 3, and therefore transistor No. 3 is held in a non-conducting condition.

The 7500 volt high voltage pulse is applied, the lamp starts its first illumination and the 160 volts d.c. supply now drops to approximately 12 volts d.c. The 160 volts d.c. terminal now has only 12 volts and under this condition current cannot flow to bias the base of transistor No. 1 due to a blocking zener and rectifier diode. Thus, transistor No. 1 is not now conducting. This in turn permits the first resistor to draw current creating a voltage bias sufficient to energize transistor No. 2. However, although transistor No. 2 is in position to conduct, it cannot because a 24 volt limiting zener will not permit current to flow at the 12 volt d.c. level. Therefore, with no current flowing through a third resistor associated with transistor No. 2, no voltage drop is developed to bias the base of transistor No. 3 and transistor No. 3 again is held in a non-conduction condition.

The lamp is now conditioning itself for full illumination and the voltage starts to go higher from the initial 12 volt d.c. The 160 volts d.c. supply now is furnishing an increasing voltage to the lamp, and, when it reaches 24 volts, the 24 volt limiting zener can conduct current to transistor No. 2. Since transistor No. 2 is already in a conducting state (due to a constant 15 volt d.c. supply), current will flow through the third resistor, developing a voltage sufficient to energize transistor No. 3 after an associated large capacitor is charged to prevent false triggering of the third transistor. With transistor No. 3 electrically conducting, it connects the dimmer control circuit into the power supply, and the unit is now ready for proper dimmer control and operation.

The above circuit has the following advantages: simplicity; solid state components—no relays or other mechanical mechanisms; the ability to repeat itself with no delay or resetting controls; the control circuit monitors the condition of the lamp itself, insuring proper time for actuating and illumination; the circuit works off the actual lamp itself, insuring a good lamp—one that will illuminate. It works off the actual power supply voltages insuring a proper power supply.

Thus, it is an object of this invention to provide a control circuit for a light source having an illumination control which cuts out the illumination control circuitry until the lamp is fired and is initially illuminated. Thereafter, the dimmer control is placed in the circuit to permit the lamp illumination or brightness to be adjusted. This new control circuit permits the lamp to be energized and illuminated regardless of the level of illumination dialed on the dimmer control.

These and other objects of the invention will become apparent to those having ordinary skill in the art with reference to the following description, drawings and appended claims.

BRIEF DESCRIPTION OF THE DRAWINGS

FIG. 1 is a pictorial illustration of the light source having a dimmer control circuit disclosed herein;

FIG. 2 is a top plan view of the internal, physical components of the light source;

FIG. 3 is an illustration of the physical components involved with the control circuit disclosed herein.

DESCRIPTION

Figure 4:
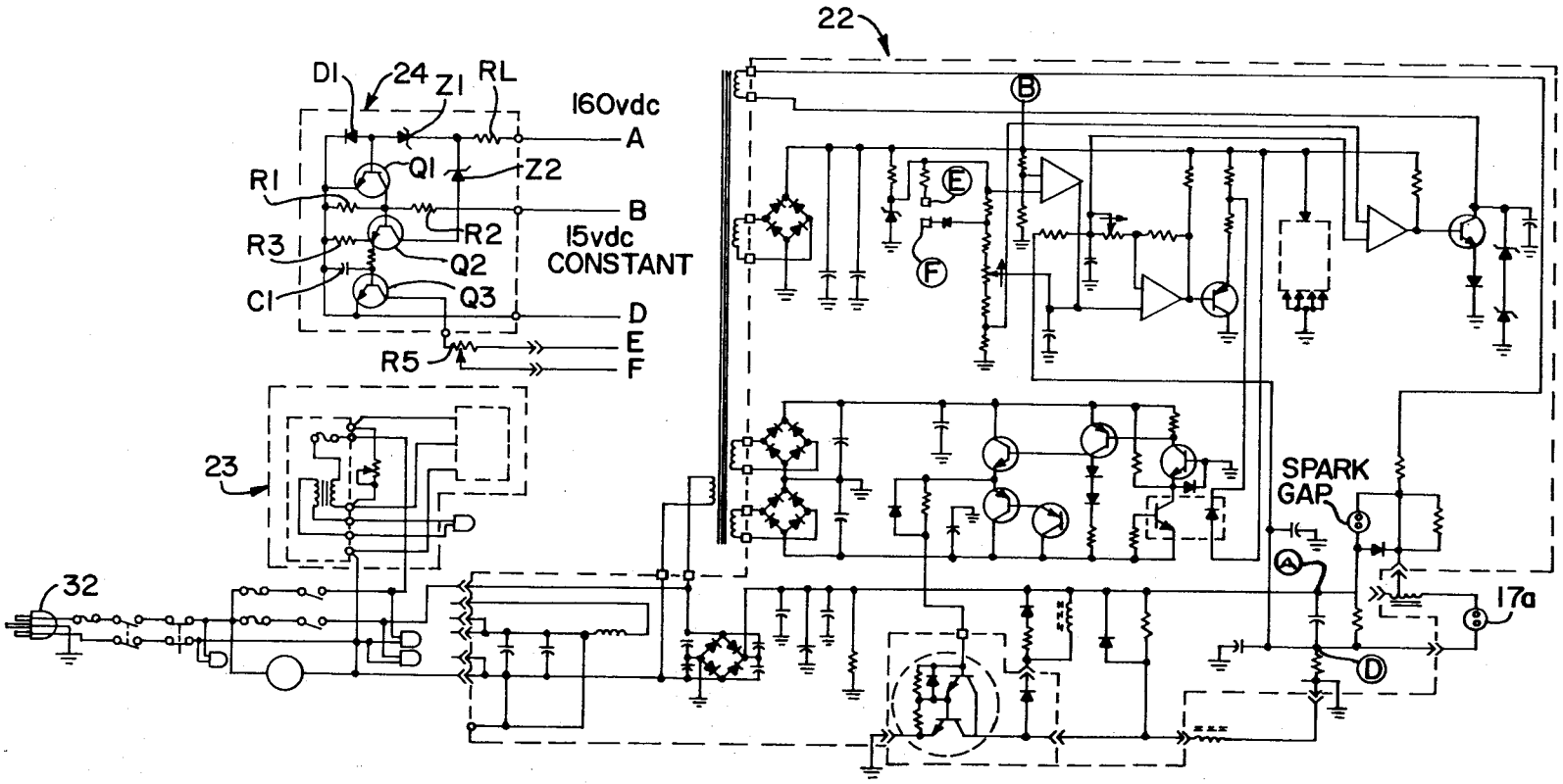
FIG. 4 is a diagram of the main power circuit and the control circuit which is disclosed herein.

Referring now to the drawings and in particular to FIG. 1, there is shown a light source 10. This particular light source has a pair of handles 11 which render it highly mobile and capable to being stacked, for example, on hospital carts or being carried by maintenance personnel and used to inspect equipment on site such as would be used by aircraft mechanics and inspection and testing personnel. A typical light cable 12 is attached to a turret 14 for aligning the cable with light sources as required or as selected. Typical power cable 13 extends from the rear of the unit 10 and may be wrapped around carrying handle 13*a*.

On the face of the light source console 10 is a main power switch 15 and a pair of light switches 16, 17 which operate incandescent light 16*a* and an arc type of high intensity lamp designated 17*a* respectively. Knob 18 is connected with a dimmer potentiometer associated with the light 16*a* and thus may be used to control the intensity of light 16*a*. Dimmer knob 19 is connected with a potentiometer or variable resistance and can be rotated to adjust the illumination emanating from the high intensity, arc clamp 17*a*.

As shown in FIG. 4, the circuit is broken down into three sections. The power supply circuit is designated 22, an incandescent light circuit supply is designated generally by the numeral 23, and, the control circuit of this disclosure is designated by the numeral 24. The control circuit shown schematically in FIG. 4 by the numeral 24 corresponds with the circuit elements shown physically on the circuit board 25 of FIG. 3.

An ammeter may be provided on the front of the control panel to give a meter reading showing the degree of illumination of the high intensity lamp 17*a*. As shown in FIG. 2, a blower 28 is contained within the housing and is on at all times when the light 16*a* and lamp 17*a* are energized to provide cooling. Cooling for some circuit elements is provided by a heat sink such as that designated by the numeral 30 as shown in FIG. 2.

The physical elements involved in the control circuit of this invention are shown on a typical circuit board illustrated in FIG. 3 and designated by the numeral 25. The circuit board shown is of such a size that is approximately 3 inches square and thus can be easily added at any convenient location in the unit. As shown in FIG. 2, the circuit board 25 is attached adjacent heat sink 30.

The power circuit designated as 22 in FIG. 4 is a circuit that has been designed by the manufacturer of the arc lamp, General Electric Corporation, Specialty Transformer Products Section, 1701 College St., Fort Wayne, Ind. 46804. The various components of the circuits 22, 23 are shown schematically in General Electric Corporation blueprint 263D 403AG which is incorporated herein by reference to illustrate the state of the art. However, it is understood that any other power supply circuit could be used to power an arc lamp 17*a*. The General Electric power circuit 22 is also shown in the Schematic for Cine-Arc Fiber Light Source Model No. A 5000.40, manufactured by the Richard Wolf Medical Instruments Co., 7046 Lyndon Ave., Rosemont, Ill., which is also incorporated by reference herein to show the state of the art of arc lamp power sources and are not described at any great length.

Without the control circuit 24, a variable resistor or potentiometer controls the intensity of the lamp 17*a* once it has been triggered by a required high voltage. As mentioned earlier, when the resistor R5 is directly wired into the circuit and at a low setting, it will prevent lamp 17*a* from triggering.

With the control circuit 24 of this disclosure, portions of circuit 24 designated A and D are wired at similar points A and D in the power circuit 22.

Electronically, the control circuit 24 consists of three transistors Q1, Q2, Q3 that are switched to either a conducting condition or an off condition as the lamp 17*a* goes through the cycle necessary for proper illumination. The entire purpose of control circuit 24 is to hold transistor Q3 in a non-conducting condition until lamp 17*a* is ready for the dimming control circuit 24 to be cut into the power circuit 22.

Control circuit 24 is wired across the lamp circuit 25 at points A and D corresponding with points A and D on the control circuit 24. Because of this it must start its control with the 160 volt d.c. voltage. A 7500 volt pulse is present also, but the designers of the present power supplies have provided a means whereby this voltage is applied to the lamp 17*a* but it is not sensed in the 160 volt d.c. circuit 24.

With the lamp 17*a* at rest, not ignited, the 160 volts d.c. will be across the control circuit 24 and across the lamp 17*a*.

The 160 volts flows across a limiting resistor RL of 6800 ohms, a 51 volt zener limiting diode Z1 and a rectifier diode D1. In a conducting condition, all silicon diodes such as D1 have a voltage drop of approximately 0.6 volts. This voltage is used to bias transistor Q1 in a conducting condition. While transistor Q1 is conducting, it effectively shorts out resistor R1 of 3000 ohms. With resistor R1 shorted out, i.e., not conducting, there is insufficient bias to transistor Q2 to place it into a conducting condition. With transistor Q2 in a non-conducting condition, the 160 volt d.c. cannot flow through the second path provided—namely, RL, the 6800 ohm resistor, Z2, a 24 volt zener, transistor Q2 and resistor R3 of 680 ohms. No current is flowing in R3, the 680 ohm resistor, no voltage is developed to bias Q3, and therefore transistor Q3 is held in a non-conducting condition.

The 7500 volt high voltage pulse is applied across electrodes of lamp 17*a*, lamp 17*a* starts its first illumination and the 160 volts d.c. supply at point A in control circuit 24 now drops to approximately 12 volts d.c. The 160 volt d.c. terminal now has only 12 volts and under this condition current cannot flow through R1, the 6800 ohm resistor, Z1, the 51 V zener and rectifier diode D1. Thus, the transistor Q1 is not now conducting. This in turn permits R1, the 3k resistor to draw current from the constant 15 volt supply, creating a voltage bias sufficient to energize transistor Q2. However, while transistor Q2 is in position to conduct, it cannot because the 24 volt limiting zener, Z2, will not permit current to flow at the 12 volt d.c. level. Therefore, with no current flowing through 680 resistor R3, no voltage is developed and transistor Q3 again is held in a non-conducting condition.

Because the initial triggering voltage across the lamp electrodes decreases the resistance, lamp 17*a* is now conditioning itself for full illumination and the voltage starts to go higher from the initial 12 volts at point A in control circuit 24. The 160 volts d.c. supply now is furnishing an increasing voltage to the lamp 17*a*, and, when the voltage reaches 24 volts, the 24 volt limiting zener Z2 can conduct. diode D1. In a conducting condition, all silicon diodes such as D1 have a voltage drop of approximately 0.6 volts. This voltage is used to bias transistor Q1 in a conducting condition. While transistor Q1 is conducting, it effectively shorts out resistor R1 of 3000 ohms. With resistor R1 shorted out, i.e., not conducting, there is insufficient bias to transistor Q2 to place it into a conducting condition. With transistor Q2 in a non-conducting condition, the 160 volt d.c. cannot flow through the second path provided—namely, RL, the 6800 ohm resistor, Z2, a 24 volt zener, transistor Q2 and resistor R3 of 680 ohms. No current is flowing in R3, the 680 ohm resistor, no voltage is developed to bias Q3, and therefore transistor Q3 is held in a non-conducting condition.

The 7500 volt high voltage pulse is applied across electrodes of lamp 17*a*, lamp 17*a* starts its first illumination and the 160 volts d.c. supply at point A in control circuit 24 now drops to approximately 12 volts d.c. The 160 volt d.c. terminal now has only 12 volts and under this condition current cannot flow through R1, the 6800 ohm resistor, Z1, the 51 V zener and rectifier diode D1. Thus, the transistor Q1 is not now conducting. This in turn permits R1, the 3k resistor to draw current from the constant 15 volt supply, creating a voltage bias sufficient to energize transistor Q2. However, while transistor Q2 is in position to conduct, it cannot because the 24 volt limiting zener, Z2, will not permit current to flow at the 12 volt d.c. level. Therefore, with no current flowing through 680 resistor R3, no voltage is developed and transistor Q3 again is held in a non-conducting condition. Since transistor Q2 is already in a conducting state due to the constant 15 volt supply, current will flow through the 680 ohms resistor R3, developing a voltage sufficient to energize transistor Q3. Transistor Q3 will trigger and switch to an on or conducting condition once an associated capacitor C1 has been charged. C1 may be a 1000 $\mu$f capacitor which must be charged before Q3 will switch on. Capacitor C1 prevents false switching of the lamp such as could occur if an operator of the unit rapidly switched the main power switch on and off. With transistor Q3 electrically conducting, it connects the dimmer control (adjustable resistor, potentiometer R5) into operation by coupling points E, F on circuit 24 with points E, F on circuit 22 whereby arc lamp 17*a* is now ready for proper dimmer control and operation.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A control device for initial triggering and subsequent intensity of a high intensity arc lamp having electrodes and receiving an initial high voltage to initiate ionization in the arc lamp to begin illumination, the improvement comprising:

sensing and control means having current limiting and switching devices operative between on and off conditions to monitor and permit triggering of the arc lamp and subsequent illumination control of the arc lamp by a dimmer control;

means connecting the sensing and control means electrically with the arc lamp to sense the electrical condition existing at the lamp electrodes;

said sensing means including a first electrical path for carrying current at an initial high voltage followed by a lower voltage as the lamp begins illumination, and, a second electrical path providing a constant, lower voltage;

first current control means in the first electrical path being coupled to a first switch means;

a third electrical path with means connected with the first electrical path and having second current limiting means and a second swtich means;

means connecting the second switch means with the second electrical path carrying the constant voltage;

a coupling and connecting path with means connected with the second switch means; and, third switch means with means connected with an arc lamp control resistor and with the coupling and connecting path to connect with the second switch means;

whereby after initial high voltage triggering and upon initial illumination of the arc lamp at a high voltage condition, the first switch means is biased into an on condition and thereby maintains the second switch means in an off, non-conducting condition, and, after initial illumination, the voltage in the first electrical path drops and is blocked from the first switch means by the first current control means, thereby permitting the second switch means to switch to the on condition, triggered by said lower, constant control voltage and thereby developing a bias permitting the third switch means to trigger to an on, conducting condition to electrically connect the lamp dimmer control into the circuit for adjusting the illumination of the arc lamp.

2. The control device of claim 1 wherein said sensing means comprises electronic members including:

said first current control means includes zener diode means in the first electrical path and also includes simple diode means;

said first switch means comprising a first transistor;

said simple diode and the first transistor having means coupled electrically for the simple diode to bias the first transistor between the on and off conditions;

a second transistor having means coupled to said first transistor and preventing the second transistor from reaching an on condition when the first transistor is in an on condition.

3. The control device of claim 2, wherein the second electrical path includes:

first and second resistors arranged on each side of the base of the second transistor, said first resistor disposed to be in a non-conducting condition when the first transistor is in the on condition and disposed to be in a conducting condition to bias the second transistor to an on condition when the first transistor is in an off condition.

4. The control device of claim 2 and:

a third transistor with means coupled with the second transistor;

zener diode control means connected in the third electrical path to block current below a predetermined voltage to the second transistor.

5. The control device of claim 2 and:

said second transistor being operatively connected with a constant voltage supply and having a first resistor associated therewith to provide a bias to switch the second transistor from an off condition to an on condition when said first transistor is in an off, non-conducting condition.

6. The control device of claim 3 and:

said third transistor having a base and having an emitter;

capacitor means connected across said base and across said emitter to provide a time delay in triggering of the base and turning the third transistor from an off condition to an on condition.

7. A method of monitoring the triggering and electronic condition of a high intensity arc lamp comprising the steps of:

providing a control circuit having contacts electrically connected to monitor the electrical condition at the electrodes of the arc lamp;

providing a first transistor to monitor and turn on after initial triggering of the arc lamp at a high voltage;

switching a second transistor to an off condition when the first transistor is in an on condition;

providing a limiting electronic means to deenergize and switch to an off condition the first transistor when voltage across the electrodes of the arc lamp falls below a point predetermined by the limiting electronic means;

providing a constant voltage supply to the base of the second transistor;

biasing the base of the second transistor when the first transistor is in an off condition to switch the second transistor to an on condition;

providing means for biasing the base of a third transistor when the second transistor is activated;

delaying activation of the third transistor by providing a time delay capacitor across the base and emitter of the third transistor to prevent false triggering of the control circuit and to delay connecting of a arc lamp dimmer control;

connecting and cutting in a variable resistor across the electrodes of the arc lamp to control illumination of the arc lamp when the third transistor has been turned to an on, conducting condition.

* * * * *